United States Patent [19]

Childs et al.

[11] 4,003,807

[45] Jan. 18, 1977

[54] ELECTROCHEMICAL FLUORINATION OF KETONES WITHIN THE PORES OF AN ANODE

[75] Inventors: William V. Childs; Forrest N. Ruehlen, both of Bartlesville, Okla.

[73] Assignee: Phillips Petroleum Company, Bartlesville, Okla.

[22] Filed: June 2, 1975

[21] Appl. No.: 583,315

[52] U.S. Cl. ..... 204/59 F
[51] Int. Cl.[2] ..... C25B 3/08
[58] Field of Search ..... 204/59 R, 59 F

[56] References Cited

UNITED STATES PATENTS

| | | | |
|---|---|---|---|
| 2,717,871 | 9/1955 | Scholberg et al. | 204/59 F |
| 3,379,765 | 4/1968 | Anello et al. | 260/58 B |
| 3,655,535 | 4/1972 | Ruehlen et al. | 204/59 F |

*Primary Examiner*—F. Edmundson

[57] ABSTRACT

Low molecular weight ketones are fluorinated by passing same into contact with an essentially anhydrous liquid hydrogen fluoride electrolyte within the pores of a porous anode.

10 Claims, No Drawings

ELECTROCHEMICAL FLUORINATION OF KETONES WITHIN THE PORES OF AN ANODE

BACKGROUND OF THE INVENTION

The invention relates to the direct electrochemical fluorination of ketones utilizing a porous carbon anode in which the reaction takes place.

Electrochemical fluorination of various organic and even inorganic materials is well known in the art. A wide variety of materials except ketones have been fluorinated by one means or another. Perfluorinated ketones have been produced by such complicated processes as first esterifying a secondary alcohol with an acyl fluoride; thereafter, subjecting the resulting esters to electrochemical fluorination to produce perfluorinated esters; and finally effecting cleavage of the perfluorinated esters to produce perfluorinated ketones.

SUMMARY OF THE INVENTION

It is an object of this invention to provide a one-step electrochemical process for the fluorination of ketones.

In accordance with this invention, a low molecular weight ketone is contacted with an essentially anhydrous liquid hydrogen fluoride electrolyte within the pores of a porous anode of an electrochemical fluorination cell.

DESCRIPTION OF THE PREFERRED EMBODIMENTS

Ketones which are suitable for use in this invention include those of general formula $$(C_nHX_{2n})\,\overset{\overset{\displaystyle O}{\|}}{C}\,(C_mX_{2m+1})$$

wherein X is hydrogen or fluorine radicals, wherein $m$ and $n$ are integers having the value 1, 2 or 3 and wherein the sum $m+n$ is 2, 3 or 4.

Examples of useful ketones include acetone, 2-butanone, 3-methyl-2-butanone, 2-pentanone, 3-pentanone, fluoroacetone, 1,1-difluoroacetone, 1,3-difluoroacetone, 1,1,1-trifluoroacetone, 1,1,3-trifluoroacetone, 1,1,1,3-tetrafluoroacetone, 1,1,3,3-tetrafluoroacetone, pentafluoroacetone, 3-fluorobutanone, 1,1,1,3,3-pentafluorobutanone, 1,1,4,4-tetrafluoro-3-(trifluoromethyl)-2-butanone, 1,3,4,5-tetrafluoro-2-pentanone, 1,1,2,2,4,4,5,5-octafluoro-3-pentanone, etc., and mixtures thereof.

The more volatile, lower molecular weight ketone feedstocks are presently preferred. The less volatile, somewhat higher molecular weight ketone feedstocks can be used, if desired, with the assistance of a carrier gas such as helium, argon, nitrogen, methane, carbon tetrafluoride and the like. Acetone and its partially fluorinated derivatives are particularly suitable feedstocks.

The electrochemical process of the present invention can be carried out in any suitable electrochemical fluorination cell which has means for continuously introducing the feedstock into the pores of a porous carbon anode, which is immersed in a current-conducting essentially anhydrous HF-containing electrolyte, and means for continuously recovering fluorinated products from the cell. One cell which is particularly applicable is described in U.S. Pat. No. 3,692,660, the disclosure of which is hereby incorporated by reference.

The invention process can use any suitable porous carbon anode into which the ketone feedstock can be introduced and from which the fluorinated products stream can be recovered without said stream coming into contact with the bulk of the liquid electrolyte. The composition, configuration, and description of a number of such suitable porous carbon anodes is disclosed in U.S. Pat. No. 3,711,396, the disclosure of which is hereby incorporated by reference. Cylindrical anodes having cavities on their undersides into which feedstock can be introduced are presently preferred. While it is not desired to limit the invention to any theory of operation, it is believed that the electrolyte partially penetrates the electrode through some of the larger pores. The feed material distributes itself throughout the porous electrode and migrates to near the outer surface to form a three-phase boundary of feed electrolyte, and electrode element, at which point the reaction takes place. The product, and unreacted feed, if any, then migrate up to the portion of the anode above the electrolyte level where they are collected without ever having broken out into contact with the bulk of the electrolyte. In some instances the feed can momentarily be in contact with the bulk of the electrolyte when it is introduced into a cavity at the bottom of the anode.

Fluorination of an appropriate feedstock employing the above-described cell and anode is conducted under conditions of temperature, pressure, voltage, current, feed rate, etc., as described in said U.S. Pat. No. 3,711,396.

The electrochemical fluorination process is carried out in a medium of hydrogen fluoride electrolyte. Although said hydrogen fluoride electrolyte can contain small amounts of water, such as up to about 5 weight percent, it is preferred that said electrolyte be essentially anhydrous. The hydrogen fluoride electrolyte is consumed in the reaction and must be either continuously or intermittently replaced in the cell.

Pure anhydrous liquid hydrogen fluoride is nonconductive. The essentially anhydrous liquid hydrogen fluoride described above has a low conductivity which, generally speaking, is lower than desired for practical operation. To provide adequate conductivity in the electrolyte, and to reduce the hydrogen fluoride vapor pressure at cell operating conditions, an inorganic additive can be incorporated in the electrolyte. Examples of suitable additives are inorganic compounds which are soluble in liquid hydrogen fluoride and provide effective electrolytic conductivity. The presently preferred additives are the alkali metal (sodium, potassium, lithium, rubidium, and cesium) fluorides and ammonium fluoride. Other additives which can be employed are sulfuric acid and phosphoric acid. Potassium fluoride, cesium fluoride, and rubidium fluoride are the presently preferred additives. Potassium fluoride is the presently most preferred additive. Said additives can be utilized in any suitable molar ratio of additive to hydrogen fluoride within the range of from 1:4.5 to 1:1, preferably 1:4 to 1:2. The presently most preferred electrolytes are those which correspond approximately to the formulas KF.2HF, KF.3HF, or KF.4HF. Such electrolytes can be conveniently prepared by adding the required quantity of hydrogen fluoride to KF.HF (potassium bifluoride). In general, said additives are not consumed in the process and can be used indefinitely. Said additives are frequently referred to as conductivity additives for convenience.

Generally speaking, any combinaton of operating parameters is useful which will provide contact of the feed with a portion of the liquid electrolyte, such as KF.2HF, within the pores of the nonwetting porous carbon anode and which will convert at least a portion of said feed within the confines of the porous carbon anode during the upward passage of the feed through the anode without contact with the bulk of the electrolyte outside the anode. Ordinarily, the fluorination can be carried out at temperatures of 50°–200° C. at which the vapor pressure of the liquid electrolyte is not excessive. The preferred temperature range is 60°–120° C. The fluorination can be carried out at any convenient pressure both above and below atmospheric and is generally carried out at 0–500 psig.

The ketone is introduced into the pores of an anode, having a given porosity and permeability, at a rate which is insufficient to bubble the feed into the bulk of the liquid electrolyte. That is, the feedstock is introduced into the porous anode at a point near its bottom and is permitted to exit the porous anode at a point near its top, preferably above the surface of the liquid electrolyte.

Current densities on the porous anode will generally be in the range of 25–1000, preferably 50–500, ma/cm$^2$ of anode geometric surface area. The cell voltage will depend on the geometry and materials in the cell, but will generally be in the range of 4–12 volts. The current and feed rates will ordinarily be such that 10–100, preferably 50–80, percent of the replaceable hydrogen in the total feedstock will be converted, per pass, through the cell.

Electrochemical fluorination of the ketones described above yields product ketones containing at least one more fluorine atom per molecule than the feed ketones.

When the reactant and/or product ketones are mixtures of partially fluorinated ketones and completely fluorinated ketones, the average fluorine content of the product ketones is higher than that of the reactant ketones.

Separation of unreacted feed, by-products and mixtures of partially and completely fluorinated ketones is accomplished by procedures which are well known in the art, such as fractional distillation. Pure products or mixtures of products which contain less than the desired amount of fluorine can be recycled to the electrolytic cell either alone or in combination with fresh feed.

The following run illustrates the practice of this invention in the electrochemical fluorination of acetone.

The electrolytic cell employed in this run comprised a circular iron cathode and a cylindrical carbon anode. The anode was constructed of porous carbon having 40 to 50 percent porosity and 0.2 to 0.4 mm mean pore diameter. The 14-inch long by 1⅜-inch diameter cylindrical anode contained a ⅝-inch deep gas cap in the lower end of the anode and a copper current collector inserted 5 inches deep in the upper end of the anode. The anode in the electrolytic cell was immersed to the depth of 10 inches in molten KF.2HF as the electrolyte. With the cell operating at 53.6 amps, 8.8 volts and 85° C., acetone was introduced into the gas cap at the bottom of the anode at 20 gm/hr. by means of a feed pipe which passed through a portion of the anode body. Effluent from the cell collected over a two-hour period (74.1 gm) was analyzed by gas-liquid chromatography. The sample of effluent to be analyzed was first passed through a 2-inch long tube packed with sodium fluoride pellets to remove hydrogen fluoride. The composition of the thus-treated effluent is given in Table I. The various components of the effluent were identified by mass spectrometric analysis of the components eluting from a gas-liquid chromatograph.

TABLE I

| Component[a] | Area Percent[b] |
|---|---|
| Trifluoroacetyl fluoride | 2.7 |
| Hexafluoroacetone | 18.4 |
| Pentafluoroacetone | 0.8 |
| 1,1,1-Trifluoroacetone } C | |
| Acetyl fluoride } C | 15.7 |
| Difluoroacetyl fluoride | 3.7 |
| 1,1-Difluoroacetone | 0.9 |
| Acetone | 38.0 |
| Monofluoroacetone | 5.0 |
| 1,1,3-Trifluoroacetone | 6.3 |
| 1,3-Difluoroacetone | 6.9 |
| Others[d] | 1.6 |

[a]In order of increasing retention time from glc column.
[b]Percent of total area under curves on glc tracing.
[c]Not separated.
[d]Unidentified minor components eluting throughout glc trace.

The data in Table I show that approximately 62 percent of the acetone feed was converted to fluorinated products which were predominantly completely and partially fluorinated acetones.

While the invention has been described in detail for the purpose of illustration, it is not to be construed as limited thereby but is intended to cover all changes and modifications within the spirit and scope thereof.

What is claimed is:

1. A process for the electrochemical fluorination of a ketone having the formula $$(C_nHX_{2n})\overset{\overset{\displaystyle O}{\|}}{C}(C_mX_{2m+1})$$

wherein X is hydrogen or fluorine, wherein $m$ and $n$ are integers having the value of 1, 2 or 3 and wherein the sum of $m+n$ is 2, 3 or 4 comprising:

passing an electric current through a current-conducting essentially anhydrous liquid hydrogen fluoride electrolyte contained in an electrolysis cell provided with a cathode and a porous carbon anode;

contacting said ketone with said electrolyte within pores of said anode to thus at least partially fluorinate at least a portion of said ketone; and recovering perfluorinated product from said anode.

2. A method according to claim 1 wherein said ketone is selected from the group consisting of acetone, partially fluorinated acetone and mixtures thereof.

3. A process according to claim 2 wherein said product comprises hexafluoroacetone.

4. A method according to claim 3 wherein said electrochemical fluorination is carried out at a temperature within the range of 50° to 200° C., a pressure of 0 to 500 psig, a current density on said porous anode within the range of 25 to 1000 ma/cm$^2$ of anode geometric surface area, and the voltage is within the range of about 4 to 12 volts.

5. A method according to claim 1 wherein said electrochemical fluorination is carried out at a temperature within the range of 50° to 200° C., pressure within the range of 0 to 500 psig, and a current density on the porous anode within the range of 25 to 1000 ma/cm$^2$ of anode geometric surface area, and a voltage within the range of 4 to 12 volts.

6. A method according to claim 5 wherein said ketone comprises acetone and said product comprises hexafluoroacetone.

7. A method according to claim 1 wherein unreacted ketone and partially fluorinated ketone are separated from said perfluorinated product and recycled to said cell.

8. A method according to claim 7 wherein said product is hexafluoroacetone.

9. A method according to claim 7 wherein said electrolyte is essentially anhydrous liquid KF.2HF.

10. A method according to claim 1 wherein said electrolyte is essentially anhydrous liquid KF.2HF.

* * * * *